US009377257B2

(12) United States Patent
Foster

(10) Patent No.: US 9,377,257 B2
(45) **Date of Patent: *Jun. 28, 2016**

(54) SYSTEMS FOR FIREARMS

(71) Applicant: FOSTECH MFG LLC, Columbus, IN (US)

(72) Inventor: David Foster, Columbus, IN (US)

(73) Assignee: FOSTECH MFG LLC, Columbus, IN (US)

( * ) Notice: Subject to any disclaimer, the term of this patent is extended or adjusted under 35 U.S.C. 154(b) by 0 days.

This patent is subject to a terminal disclaimer.

(21) Appl. No.: 14/573,791

(22) Filed: Dec. 17, 2014

(65) Prior Publication Data

US 2015/0260470 A1 Sep. 17, 2015

Related U.S. Application Data

(60) Provisional application No. 61/917,242, filed on Dec. 17, 2013, provisional application No. 61/917,235, filed on Dec. 17, 2013.

(51) Int. Cl.

| | |
|---|---|
| ***F41A 21/48*** | (2006.01) |
| ***F41A 3/72*** | (2006.01) |
| ***F41A 5/18*** | (2006.01) |
| ***F41A 5/26*** | (2006.01) |
| ***F41A 3/36*** | (2006.01) |
| ***F41A 3/46*** | (2006.01) |
| ***F41A 5/24*** | (2006.01) |

(52) U.S. Cl.

CPC ... *F41A 3/72* (2013.01); *F41A 3/36* (2013.01); *F41A 3/46* (2013.01); *F41A 5/18* (2013.01); *F41A 5/24* (2013.01); *F41A 5/26* (2013.01); *F41A 21/48* (2013.01)

(58) Field of Classification Search

CPC ..... F41A 5/18; F41A 5/26; F41A 5/28; F41A 5/20; F41A 5/22; F41A 3/62; F41A 3/72; F41A 3/26; F41A 11/00; F41A 11/02; F41A 11/04; F41A 21/48; F41A 21/484; F41A 21/485; F41A 21/487; F41A 7/02; F41A 7/04; F41C 7/11

See application file for complete search history.

(56) References Cited

U.S. PATENT DOCUMENTS

| | | | | | |
|---|---|---|---|---|---|
| 521,202 | A | * | 6/1894 | Burgess | F41C 23/16 42/71.01 |
| 529,455 | A | * | 11/1894 | Marlin | F41A 11/04 42/75.02 |
| 1,799,284 | A | * | 4/1931 | Coupland | F41A 7/02 89/1.4 |
| 3,999,461 | A | * | 12/1976 | Johnson | F41A 9/30 42/136 |
| 4,388,773 | A | * | 6/1983 | Beretta | F41A 21/484 42/75.02 |

(Continued)

*Primary Examiner* — Bret Hayes
*Assistant Examiner* — Derrick Morgan
(74) *Attorney, Agent, or Firm* — Roberts IP Law; John Roberts

(57) ABSTRACT

Provided in one aspect is an annular gas ring within or adjacent a barrel to increase the efficient transfer of pressurized gas to one or more gas ports, which may communicate the high-pressure gas from near the chamber distally to a piston to cycle the action of the firearm. Provided in another aspect is a modular quick-disconnect barrel assembly for long-stroke gas-operated firearms such as the AK-47, which allows barrel and gas systems to be replaced together simply by pulling a single pin, thereby allowing the caliber of the firearm to be instantly changed to 12-gauge shotgun or any dimensionally smaller rifle or handgun round. A novel forward-charging handle system is also provided that works with the modular quick-disconnect barrel assembly.

9 Claims, 10 Drawing Sheets

(56) References Cited

U.S. PATENT DOCUMENTS 4,765,224 A * 8/1988 Morris ..... F41A 5/26 42/75.02
4,893,547 A * 1/1990 Atchisson ..... F41A 3/46 89/187.01
4,942,802 A * 7/1990 Stoner ..... F41A 9/32 42/25
5,896,850 A * 4/1999 Sullivan, Jr. ..... F41A 35/02 124/74
5,900,577 A * 5/1999 Robinson ..... F41A 11/02 89/156
5,959,234 A * 9/1999 Scaramucci ..... F41A 5/18 89/193
6,019,024 A * 2/2000 Robinson ..... F41A 3/72 89/1.42
6,470,617 B1 * 10/2002 Gregory ..... F41A 11/04 42/75.02
7,219,463 B2 * 5/2007 Wossner ..... F41A 3/72 42/70.11
7,302,881 B1 * 12/2007 Tertin ..... F41A 11/02 42/69.02
7,823,314 B1 * 11/2010 Wheatley ..... F41A 3/66 42/75.02
8,141,285 B2 * 3/2012 Brown ..... F41A 3/66 42/71.01
8,156,854 B2 * 4/2012 Brown ..... F41A 3/72 89/1.4
8,210,089 B2 * 7/2012 Brown ..... F41A 5/18 89/191.02
8,381,628 B1 * 2/2013 Wheatley ..... F41A 3/72 42/43
8,479,429 B2 * 7/2013 Barrett ..... F41A 3/26 42/75.02
8,640,598 B1 * 2/2014 Jackson ..... F41A 5/20 89/191.01
9,134,082 B2 * 9/2015 Brown ..... F41A 5/18
2005/0066951 A1 * 3/2005 Seekman ..... F41A 21/482 124/56
2006/0277810 A1 * 12/2006 Leitner-Wise ..... F41A 3/66 42/75.03
2010/0000139 A1 * 1/2010 Brown ..... F41A 3/66 42/96
2010/0281742 A1 * 11/2010 Barrett ..... F41A 11/04 42/75.02
2011/0271827 A1 * 11/2011 Larson ..... F41A 5/28 89/193
2012/0042769 A1 * 2/2012 Makayama ..... F41A 9/38 89/1.4
2012/0167757 A1 * 7/2012 Gomez ..... F41A 5/28 89/193
2012/0180354 A1 * 7/2012 Sullivan ..... F41A 3/26 42/16
2012/0180647 A1 * 7/2012 Dublin ..... F41A 5/18 89/191.01
2013/0139424 A1 * 6/2013 Devine ..... F41A 3/26 42/16
2013/0291420 A1 * 11/2013 Aalto ..... F41A 21/48 42/75.02
2014/0196599 A1 * 7/2014 Kenney ..... F41A 5/28 89/193
2014/0224114 A1 * 8/2014 Faxon ..... F41A 15/14 89/193
2015/0176933 A1 * 6/2015 Adams ..... F41A 5/28 89/191.02
2015/0260468 A1 * 9/2015 Foster ..... F41A 3/72 89/191.01

* cited by examiner

PRIOR ART

PRIOR ART

SYSTEMS FOR FIREARMS

CROSS-REFERENCE TO RELATED APPLICATIONS

The present application claims priority to, incorporates herein by reference, and is a non-provisional of U.S. Patent Application No. 61/917,242, filed Dec. 17, 2013. The present application also claims priority to, incorporates herein by reference, and is a non-provisional of U.S. Patent Application No. 61/917,235, filed Dec. 17, 2013.

FEDERALLY SPONSORED RESEARCH OR DEVELOPMENT

None.

TECHNICAL FIELD

The technical field is firearms, and in particular improved gas systems for firearms, improved quick-release-barrel modular systems for long-stroke gas-operated firearms, and improved forward-charging handle systems, and to firearms having any or all of these improvements.

BACKGROUND

Turning first to gas systems for firearms, gas-operation is a system used to provide energy to operate auto-loading firearms. In gas-operation, a portion of high pressure gas from the cartridge being fired is used to power a mechanism to extract the spent case and chamber a new cartridge. Energy from the gas is harnessed through either a port in the barrel or trap at the muzzle. This high-pressure gas impinges on a movable surface such as a piston head to provide motion for unlocking the action, extracting and ejecting the spent case, cocking the hammer or striker, chambering a fresh cartridge, and locking the action.

Most current gas systems employ some type of piston. The face of the piston is acted upon by gas from the combustion of the propellant from the barrel of the firearm. Early methods such as Browning's 'flapper' prototype, the Bang rifle, and Garand rifle used relatively low-pressure gas from at or near the muzzle, where the bullet exits the barrel. This, combined with more massive operating parts, reduced the strain on the mechanism. To simplify and lighten the firearm, gas from nearer the chamber needed to be used. This gas is of extremely high pressure and has sufficient force to destroy a firearm unless it is regulated somehow. Several methods are employed to regulate the energy. The M1 carbine incorporates a very short piston, or "tappet". This movement is closely restricted by a shoulder recess. Excess gas is then vented back into the bore. The M14 rifle and 60 GPMG use the White expansion and cutoff system to stop (cut off) gas from entering the cylinder once the piston has traveled a short distance. Most systems, however, vent excess gas into the atmosphere through slots, holes, or ports.

With a long-stroke system, the piston is mechanically fixed to the bolt group and moves through the entire operating cycle. This system is used in weapons such as the Bren light machine gun, AK-47, Tavor, M249 Squad Automatic Weapon, FN MAG, M1 Garand, and various semi-automatic shotguns, for example. The primary advantage of the long-stroke system, beyond design simplicity and robustness, is that the mass of the piston rod adds to the momentum of the bolt carrier enabling more positive extraction, ejection, chambering, and locking. Also, as the gas is not directed back into the chamber, the weapon stays cleaner longer thus reducing the likelihood of a malfunction.

By way of example, the functioning of a standard long-stroke gas-operated firearm such as the AK-47 will be described in detail. AK-47 rifles are so-called gas powered firearms, in which the discharge gases from a fired round of ammunition serve to automatically eject the spent cartridge casing from the just-fired round and to chamber a new round for firing. The standard charging mechanism of an AK-47 comprises a barrel in communication with a firing chamber, or breach, and a bolt used to provide access to the breach. The barrel comprises a port or similar aperture which permits some of the discharge gases created from the firing of a round of ammunition to escape the barrel through the port. The port is in communication with an adjacent chamber known as a gas block, which in turn is in communication with an adjacent, substantially cylindrical structure known as a gas tube. Contained within the gas tube is a gas piston assembly known as an operating rod. The operating rod has a forward portion comprising a piston with an outside diameter substantially the same as the inside diameter of the gas tube. The rearward end of the operating rod is in connection with the bolt carrier assembly. The operating rod and carrier assembly is designed to move forward and rearward within the gas tube, with its rearward movement designed to simultaneously force the bolt assembly rearward, which in turn compresses a recoil spring mechanism. The recoil spring mechanism in turn forces the bolt assembly forward, returning it to its firing position, which in turn moves the operating rod forward within the gas tube.

A standard AK-47 must be charged in order to operate. Charging of the firearm comprises the loading and reloading of ammunition into the firing chamber and occurs during the rearward and forward movement of the bolt assembly described above. During operation, charging is done automatically by utilizing the discharge gases of a fired round of ammunition. When a round is fired, the cartridge casing remains at one end of the barrel and the gases formed by the explosion force the bullet to travel down the length of the barrel. As the bullet passes the barrel port, some of the discharge gases escape through the barrel port and pass through the gas block into the gas tube, where the gases impinge upon the forward portion of the operating rod, driving it rearward. This rearward travel of the operating rod moves the bolt rearward, opening the breach, ejecting the spent cartridge casing from the breach, and compressing the recoil spring mechanism in connection with the rear portion of the bolt. While the bolt is thus in its rearward position and the breach is opened, a new round may be loaded into the breach by action of a spring mechanism in an ammunition magazine. The bolt is returned to its forward position by the recoil spring mechanism, closing the breach and returning the operating rod to its forward position. This process may continue by continuing to pull the trigger until all of the ammunition is used and the ammunition magazine and the firing chamber are both emptied.

Simplified section views of a typical long-stroke gas-operation system in use are depicted in FIGS. 1A-1E. A typical long-stroke gas-operation system 100 of a firearm may comprise a barrel 105 having a gas port 110 located distally down the barrel 105, well away from the chamber 170. The gas port 110 vents part of the pressurized gas 165 resulting from the firing of gunpowder 155 causing a bullet or other projectile(s) 150 (herein collectively, "bullet 150") to travel down the barrel 105 from a proximal end near the chamber 170 to a distal end where the bullet exits the barrel 105 through a muzzle (not shown). The gas port 110 typically vents a small portion of the pressurized gas 165 into an adjacent cylinder 115 just beyond a piston 120 located in the cylinder 115, as depicted in FIGS. 1B-1D. The piston 120 is typically connected by a piston rod or operation rod 125 to a bolt carrier 130, those parts together comprising a carrier assembly that typically slides in the opposite direction of the bullet 150 (i.e., rearward, or to the right in FIGS. 1-4 and 7-8B) when the pressurized gas 165 travels down the barrel 105 behind the bullet 150, through the gas port 110, into the cylinder 115, and impinges on the face of the piston 120, as depicted in FIGS. 1B-1D. The momentum of the rearward travel of the bolt carrier assembly typically causes the bolt carrier 130 to unlock a locking block 145 that locks the bolt 140 to the chamber 170 (i.e., unlocks the "action"), and then the bolt carrier 130 pushes the bolt 140 backwards (to the right in FIGS. 1-4 and 7-8B) away from the chamber 170, while expelling the spent casing 160 and introducing a new cartridge with bullet 150 into the chamber 170, as depicted in FIG. 1E. The rearward travel of the carrier assembly is typically increasingly resisted by a spring 135, which then urges the carrier assembly to travel back in the forward direction (to the left in the Figures, FIG. IF), re-locking the bolt 140 to the chamber 170, whereupon the firearm returns to the position shown in FIG. 1A, ready to fire again.

One disadvantage of this type of system 100 is that, due to the significant mass of moving parts, a significant amount of high-pressure gas 165 is required to operate the system 100. In order to transmit the required volume of high-pressure gas 165 to the piston 120, manufacturers utilize various numbers of gas ports 110 of different sizes, typically located near or distally (to the left in the Figures) of the resting position of the piston 120 to allow the high-pressure gas 165 to flow backward (to the right in FIGS. 1-4 and 7-8B) against the face of the piston 120. There are some key limitations to this type of system 100. First, these small ports 110 are prone to clogging due to debris created when a round or bullet 150 is fired. Clogged ports 110 can cause the firearm to cease functioning as intended.

Second, the size and/or number of ports 110 can directly affect the types of loads that can be used. If the ports 110 are small or there are few of them it is more difficult for high-pressure gas 165 to be redirected to the piston 120. This results in the firearm requiring heavy loads (high-powered cartridges) in order for the gas-operation system 100 of the firearm to cycle. Alternatively, if ports 110 are larger or more numerous then gas 165 is more easily redirected, which can allow the firearm to cycle lighter loads (lower-powered cartridges). However, where large ports 110 are used, heavy loads may cause excessive wear on the firearm due to exposing the face of the piston 120 to an excessive volume of high-pressure gas 165 directly from the interior of the barrel 105.

A third limitation of typical systems 100 is the distal location of the ports 110. By placing the ports 110 in a distal portion of the barrel 150 (distally from the firing chamber 170) adjacent or beyond the resting position of the piston 120, the pressure of the high pressure gas 165 available at the ports 110 is greatly reduced and is widely variable depending on the power of the cartridge 150. Thus, present systems 100 provide inefficient and inconsistent capturing and transmission of high-pressure gas 165.

Turning next to quick-release-barrel modular systems for long-stroke gas-operated firearms, such systems are known with respect to manual-feed firearms that do not use a gas system, such as bolt-action rifles, double-barreled shotguns, pump shotguns, and lever-action rifles. Providing a quick-release-barrel modular systems for gas-operated firearms is more complex, however, since the barrel is typically integrated with part of the gas system. The M-16/AR-15 rifle is a common example of a gas-operated firearm with a removable barrel assembly. The M-16/AR-15 rifle achieves its modularity by splitting the upper and lower receivers; i.e., when removed, the barrel remains attached to the upper part of the receiver. Moreover, the M-16/AR-15 rifle is not a long-stroke system like the AK-47, so there is no carrier rod/assembly in a gas cylinder that is integrated with and adjacent to the barrel. When there is no carrier rod/assembly adjacent the barrel, quick-disconnect systems are easily employed using threaded barrels or any variety of mechanisms, usually involving rotating the barrel assembly with respect to the receiver. But when there is a carrier rod/assembly in a gas cylinder that is integrated with and adjacent to the barrel as in long-stroke gas-operated firearms such as the AK-47, M60, or M249, the barrel assembly cannot be rotated relative to the receiver. Further, removal of the barrel from such long-stroke gas-operated firearms requires that the user first remove the bolt carrier and operation rod from the receiver. Accordingly, no truly quick-disconnect system exists for removing the barrel assembly from the receiver assembly of long-stroke gas-operated firearms.

Turning now to improved forward-charging handle systems, the automatic loading cycle of each round of ammunition described above with respect to FIGS. 1A-1F takes place upon the firing of the previous round. However, the initial charging of the firearm in which the first round is loaded into the firing chamber must be accomplished manually, as no discharge gases have yet been created to accomplish this task. Initial charging of a standard AK-47 is accomplished by manually drawing the bolt assembly rearward or in the proximal direction (toward the user). This is done by manually grasping and drawing back a charging handle which is in connection with the bolt assembly and located on the right side of the firearm. Drawing the charging handle rearward results in the same loading of the round into the breach by the spring mechanism in the ammunition magazine as described above. Releasing the charging handle allows the recoil spring mechanism to return the bolt to its forward position, closing the breach, resulting in the firearm being loaded and ready for firing.

Among other things, conventional charging handles for AK-47s are located inconveniently and move back-and-forth forcefully and rapidly as the weapon is fired, posing a risk of injury to the user. Charging handles for AK-47 and other popular gas powered firearms, such as the various Kalashnikov variants (AK-74, AK-101, AK-103, and others), the Samozaryadniy Karabin sistemi Simonova (SKS) rifle and its variants, and the Fusil Automatique Leger-Light Automatic Rifle (FN-FAL) and its variants, as well as other designs, have various other drawbacks as described in U.S. Pat. No. 8,141,474 B2 to Dublin, filed Aug. 13, 2009 and issued Mar. 27, 2012 (herein "Dublin"), the entirety of which is incorporated herein by reference. While Dublin proposes a solution to address some of these issues, the charging handle system described in Dublin would have to be disassembled before removing the barrel, thus rendering it unusable with quick-release-barrel modular systems. What is needed is a charging handle system that provides the benefits of the Dublin system, but that can also be used with quick-release-barrel modular systems.

SUMMARY

Provided is a novel structure, system, and method for gas-operating firearms that elegantly overcomes the problems of the prior art while providing other advantages. With respect to improved gas systems for firearms, provided in various example embodiments is a gas system for a firearm having a barrel, comprising: one or more gas ports in gaseous communication with high-pressure gas in the interior of a firearm through an annular gas ring, the one or more gas ports in gaseous communication with a piston adapted to cycle the firearm using the high-pressure gas communicated through the one or more gas ports; wherein the annular gas ring comprises a longitudinally-extending segment through which a projectile fired by the firearm travels, the annular gas ring having a diameter larger than an inner diameter of the barrel. In various example embodiments the gas system may further comprise the annular gas ring positioned proximate a chamber adapted to house a cartridge to be fired by the firearm. In various example embodiments the gas system may further comprise the piston being located distally from the annular gas ring and the one or more gas ports being in gaseous communication with the piston through one or more longitudinally-extending gas tubes. In various example embodiments the gas system may further comprise the annular gas ring being formed in the inner diameter of the barrel. In various example embodiments the gas system may further comprise the annular gas ring being formed in the inner diameter of a chamber housing adapted to house a cartridge to be fired by the firearm. In various example embodiments the gas system may further comprise the annular gas ring being formed between a proximate end of the barrel and a distal end of a chamber housing adapted to house a cartridge to be fired by the firearm. In various example embodiments the gas system may further comprise a coupler comprising a longitudinally-extending inner circumferential surface open on two ends, a first end of the coupler adapted to receive therein the proximate end of the barrel, and a second end of the coupler adapted to receive therein the distal end of the chamber housing, such that the proximate end of the barrel and the distal end of the chamber housing are located proximate but separated from each other by a predetermined longitudinal distance within the coupler. In various example embodiments the gas system may further comprise the one or more ports being formed in the coupler. In various example embodiments the gas system may further comprise the piston being located distally from the annular gas ring and the one or more gas ports being in gaseous communication with the piston through one or more longitudinally-extending gas tubes. In various example embodiments the gas system may further comprise the one or more longitudinally-extending gas tubes comprising hollow cylinders separable from the rest of the firearm. In various example embodiments the gas system may further comprise the one or more gas ports in gaseous communication with the piston through a gas block, the gas block adapted to be in gaseous communication with the one or more longitudinally-extending gas tubes and with a cylinder housing the piston. In various example embodiments the gas system may further comprise the gas block further adapted to surround and support the barrel. In various example embodiments the gas system may further comprise the gas block and the cylinder housing the piston being one piece.

Provided in another example embodiments is a modular gas system for a firearm having a barrel, comprising: one or more gas ports in gaseous communication with high-pressure gas in the interior of a firearm, the one or more gas ports in gaseous communication with a piston adapted to cycle the firearm using the high-pressure gas communicated through the one or more gas ports; the one or more gas ports positioned proximate a chamber adapted to house a cartridge to be fired by the firearm; the piston located distally from the one or more gas ports; and the one or more gas ports in gaseous communication with the piston through one or more longitudinally-extending gas tubes. In various example embodiments the modular gas system may further comprise a coupler comprising a longitudinally-extending inner circumferential surface open on two ends, a first end of the coupler adapted to receive therein a proximate end of the barrel, and a second end of the coupler adapted to receive therein a distal end of a chamber housing, the chamber housing comprising therein a chamber adapted to house a cartridge to be fired by the firearm, the proximate end of the barrel and the distal end of the chamber housing located proximate but separated from each other by a predetermined longitudinal distance within the coupler. In various example embodiments the modular gas system may further comprise the one or more ports being formed in the coupler. In various example embodiments the modular gas system may further comprise the one or more longitudinally-extending gas tubes comprising hollow cylinders separable from the rest of the firearm. In various example embodiments the modular gas system may further comprise the one or more gas ports in gaseous communication with the piston through a gas block, the gas block adapted to be in gaseous communication with the one or more longitudinally-extending gas tubes and with a cylinder housing the piston. In various example embodiments the modular gas system may further comprise the gas block being further adapted to surround and support the barrel. In various example embodiments the modular gas system may further comprise the gas block and the cylinder housing the piston being one piece.

With respect to improved quick-release-barrel modular systems for long-stroke gas-operated firearms, provided in various example embodiments is a functional gas-operated modular firearm, comprising: a barrel assembly removably attachable with a receiver assembly solely by moving a quick-release mechanism between a first position and a second position, wherein: the receiver assembly comprises: a long-stroke gas-operation system comprising a piston and longitudinally-extending operation rod mechanically attached with and adapted to move together with a bolt group through an operating cycle of firing, extracting, and ejecting a first round and chambering a second round; a trunnion having an opening adapted to removably receive and locate therein a chamber portion of the barrel assembly; the quick-release mechanism attached with the trunnion that when in the first position is adapted to lock the barrel assembly to the receiver assembly, and that when in the second position is adapted to release the barrel assembly from the receiver assembly; and the barrel assembly comprises: a chamber portion adapted to removably engage with the trunnion and to house the first and second rounds for firing when removably engaged with the trunnion; a longitudinally extending barrel portion adapted to direct the first and second rounds after firing, and supporting thereon a gas cylinder; one or more gas communication ports adapted to communicate to the gas cylinder high-pressure gas from the firing of the first and second rounds; the gas cylinder adapted to at least partially surround the piston of the long-stroke gas-operation system when the chamber portion is removably engaged with the trunnion, and to transmit to the piston high-pressure gas from the firing of the first and second rounds that causes the long-stroke gas-operation system to move through the operating cycle. In various example embodiments the first and second rounds that the receiver assembly is adapted to house, fire, extract, eject, and chamber, include all of: any standard shotgun, rifle, or handgun round that is dimensionally no larger than a 12-gauge shotgun round. In various example embodiments the first and second rounds that the barrel assembly is adapted to house and direct are selected from the group consisting of: any standard shotgun, rifle, or handgun round that is dimensionally no larger than a 12-gauge shotgun round. In various example embodiments the system may further comprise a plurality of said barrel assemblies removably attachable with and usable with a single one of said receiver assemblies, wherein a first of said barrel assemblies is adapted to house and direct first and second rounds of a first caliber, and a second of said barrel assemblies is adapted to house and direct first and second rounds of a second caliber that is different than the first caliber. In various example embodiments the first caliber and second caliber are each selected from the group consisting of: any standard shotgun, rifle, or handgun round that is dimensionally no larger than a 12-gauge shotgun round. In various example embodiments the quick-release mechanism comprises a pin adapted to pass through a hole in the trunnion and removably engage a groove in an outer surface of the chamber portion of the barrel assembly. In various example embodiments the quick-release mechanism is adapted to be moved between the first position and the second position by hand and without tools. In various example embodiments the barrel assembly further comprises a gas adjusting system adapted to allow a user to adjust the pressure of the gas to which the piston is exposed during use. In various example embodiments the barrel assembly is adapted to be removed from the receiver assembly without rotating the barrel assembly with respect to the receiver assembly.

With respect to improved forward-charging handle systems, provided in various example embodiments is a gas-operated firearm adapted to be cycled pneumatically by a piston assembly reciprocating longitudinally between a distal position and a proximal position in a cylinder when exposed to high-pressure gas from the firing of rounds, the gas-operated firearm comprising a hand-charging system comprising: an elongated slot in a wall of the cylinder, the slot extending longitudinally from a distal portion of the wall proximally through an open gap in a proximal end of the wall; a first abutment fixedly connected with the longitudinally-reciprocating piston assembly, the first abutment protruding outwardly through the elongated slot; a charge handle structure slidably attached with an exterior surface of the cylinder and positioned to contact the first abutment and urge the longitudinally-reciprocating piston assembly in a proximal direction to charge the firearm when the charge handle structure is slid in a proximal direction; the charge handle structure adapted to return to a position distal of the first abutment and remain there during firing of rounds; wherein the cylinder is adapted to be removed from the firearm without disassembling the charge handle structure and without removing the charge handle structure from the cylinder. In various example embodiments the hand-charging system further comprises the charge handle structure comprising a second abutment adapted and positioned to contact the first abutment. In various example embodiments the hand-charging system further comprises a longitudinally-extending track attached to the wall of the cylinder proximate the elongated slot, the longitudinally-extending track adapted to slidably engage the charge handle structure. In various example embodiments the charge handle structure comprises a rail portion adapted to slide within the longitudinally-extending track and a handle portion attached to the rail portion and extending away from the longitudinally-extending track. In various example embodiments the cylinder is adapted to be removed from the firearm by sliding the cylinder distally off the piston assembly without rotating the cylinder relative to the piston assembly.

Also provided are firearms having any or all of the foregoing features, as well as their equivalents. The foregoing summary is illustrative only and is not meant to be exhaustive or limiting. Other aspects, objects, and advantages of various example embodiments will be apparent to those of skill in the art upon reviewing the accompanying drawings, disclosure, and appended claims.

DETAILED DESCRIPTION OF EXAMPLE EMBODIMENTS

Figure 1A:
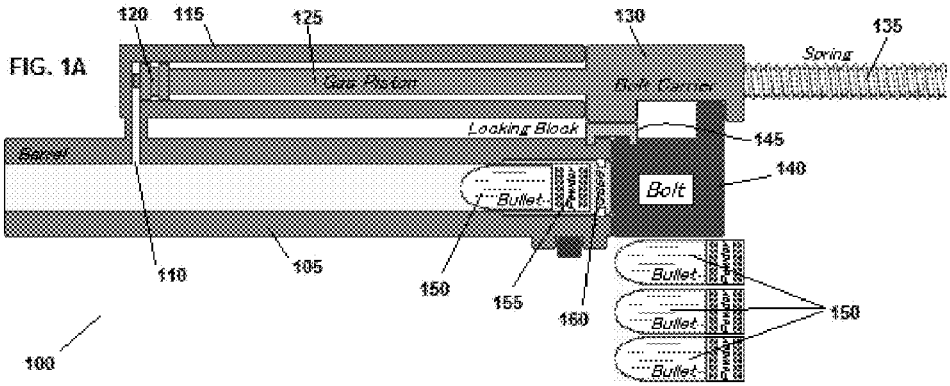
FIG. 1A is a side elevation section view of a simplified long-stroke gas-operation system of known firearms, shown loaded and ready to fire.
Figure 1B:
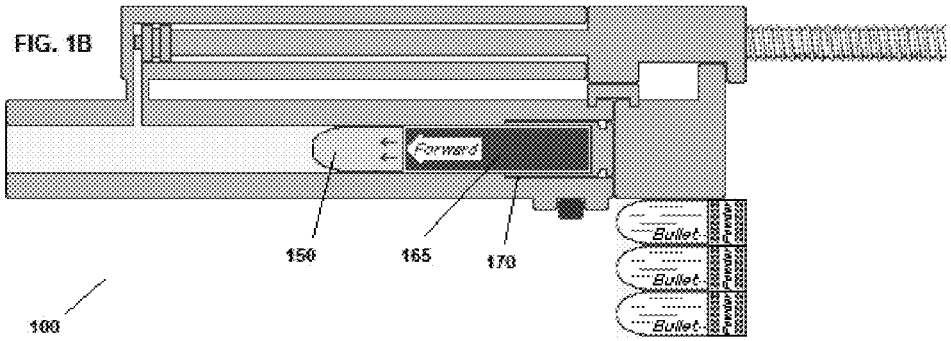
PRIOR ART FIG. 1B
FIG. 1B is a side elevation section view of the system of FIG. 1A, shown immediately after firing, as a bullet leaves the firing chamber and begins to travel down the barrel.
Figure 1C:
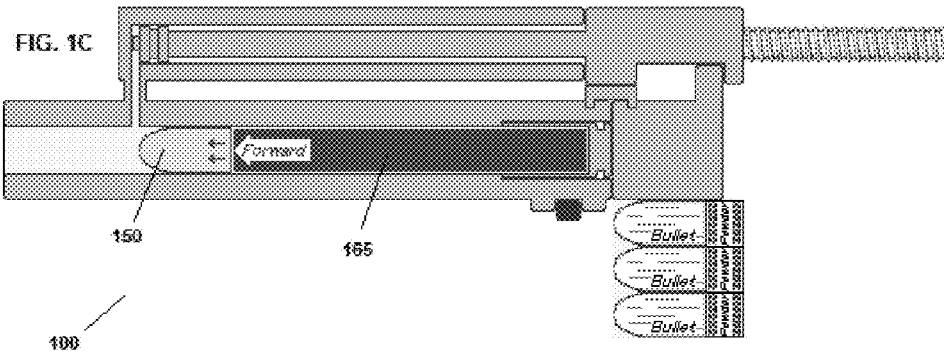
PRIOR ART FIG. 1C
FIG. 1C is a side elevation section view of the system of FIG. 1B, shown a short time later, as the bullet travels distally down the barrel.
Figure 1D:
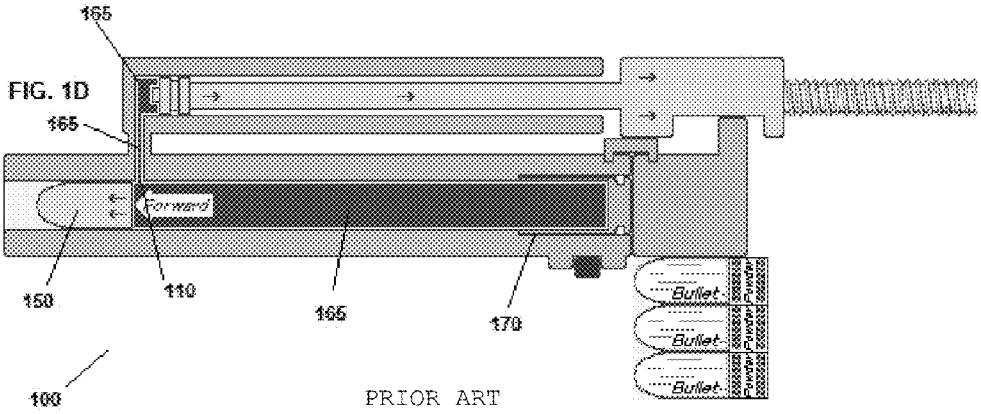
FIG. 1D is a side elevation section view of the system of FIG. 1C, shown a short time later, as the bullet travels past a gas port, allowing high-pressure gas behind the bullet to travel through the gas port to impinge on a piston, thereby causing a carrier assembly to begin to move backward (i.e., to the right).
Figure 1E:
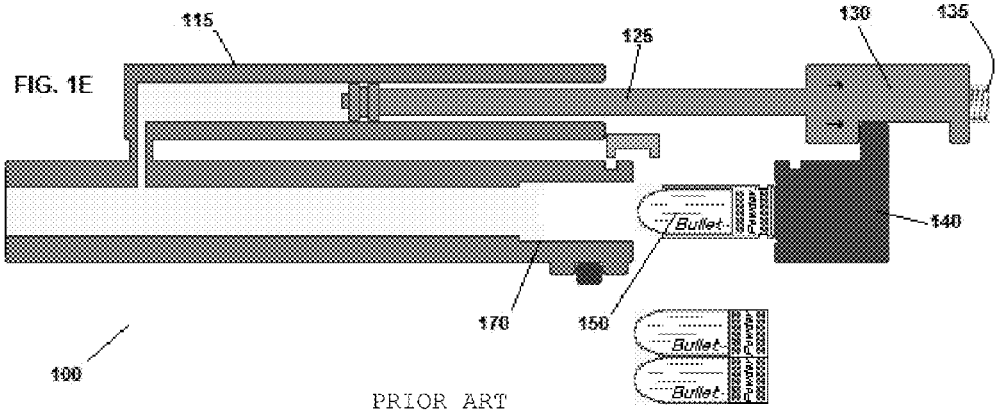
PRIOR ART FIG. 1E
FIG. 1E is a side elevation section view of the system of FIG. 1D, shown a short time later, as the carrier assembly continues to move backward (to the right) via momentum, thereby actuating the action of the firearm to automatically reload the firearm.
Figure 1F:
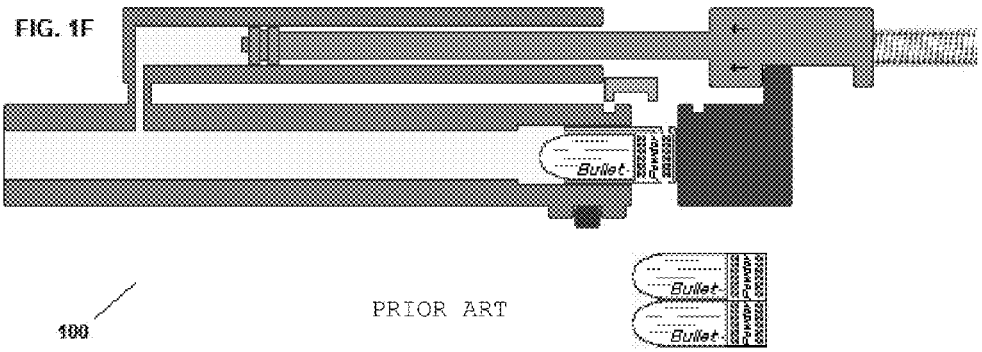
PRIOR ART FIG. 1F
FIG. 1F is a side elevation section view of the system of FIG. 1E, shown a short time later, as the carrier assembly returns toward its starting position as shown in FIG. 1A.

Reference will now be made in detail to some specific example embodiments, including any best mode contemplated by the inventor. Examples of these specific embodiments are illustrated in the accompanying drawings. While the invention is described in conjunction with these specific embodiments, it will be understood that it is not intended to limit the invention to the described or illustrated embodiments. On the contrary, it is intended to cover alternatives, modifications, and equivalents as may be included within the spirit and scope of the invention as defined by the appended claims.

In the following description, numerous specific details are set forth in order to provide a thorough understanding of the present invention. Particular example embodiments may be implemented without some or all of these features or specific details. In other instances, components and procedures well known to persons of skill in the art have not been described in detail in order not to obscure inventive aspects.

Various techniques and mechanisms will sometimes be described in singular form for clarity. However, it should be noted that some embodiments may include multiple iterations of a technique or multiple components, mechanisms, and the like, unless noted otherwise. Similarly, various steps of the methods shown and described herein are not necessarily performed in the order indicated, or performed at all in certain embodiments. Accordingly, some implementations of the methods discussed herein may include more or fewer steps than those shown or described.

Further, the example techniques and mechanisms described herein will sometimes describe a connection, relationship or communication between two or more items or entities. It should be noted that a connection or relationship between entities does not necessarily mean a direct, unimpeded connection, as a variety of other entities or processes may reside or occur between any two entities. Consequently, an indicated connection does not necessarily mean a direct, unimpeded connection unless otherwise noted.

Referring now in detail to the drawings wherein like elements are indicated by like numerals, there are shown various aspects of example firearms with improved gas systems. With respect to the example embodiments shown in FIGS. 2A-2E, 3 and 4, in one aspect gas systems 200, 300 may be provided with gas ports 210, 310 that may be in gaseous communication with high-pressure gas 165 in the interior of a firearm through an annular gas ring 207, 307. Annular gas ring 207, 307 may comprise a longitudinally-extending segment through which the projectile 150 travels, which has a diameter larger than the inner diameter of the barrel 205, 305. An annular gas ring 207, 307 can be machined or otherwise formed into the inner diameter of the barrel 205, 305 or the chamber housing 371, or may be defined by a member connecting the barrel 305 with the firing chamber 370, such as a coupler 390 (shown in FIGS. 3 and 4). Annular gas ring 207, 307 may have any suitable cross-sectional profile, such as curved, angled, or squared-off, and may be defined by a locus of points separated from the centerline of the barrel 205, 305 by a constant radial distance, or may have a variable radial distance, for instance increasing near the one or more gas ports 210, 310. It has been found that locating gas ports 210, 310 in annular gas rings 207, 307 surprisingly improves the efficiency with which high-pressure gas 165 is captured and directed into the gas ports 210, 310.

In another example aspect of improved gas systems 200, 300, one or more gas ports 210, 310 may be positioned proximate the firearms' respective chambers 170, 370. In these example embodiments, high-pressure gas 165 may be communicated from the highest pressure region in the firearm, near the chamber 170, 370, through one or more gas ports 210, 310, into one or more gas tubes 215, 365 that communicate the high-pressure gas 165 from proximate the chamber 170, 370 area, distally to a distally located piston 120, 320. This has been found to provide the surprising benefit of almost instantaneously communicating to piston 120, 320 high-pressure gas 165 having significantly improved consistency in pressure, regardless whether heavy or light loads are used, while providing sufficient energy to drive piston 120, 320 even when very light loads are used.

Figure 2A:
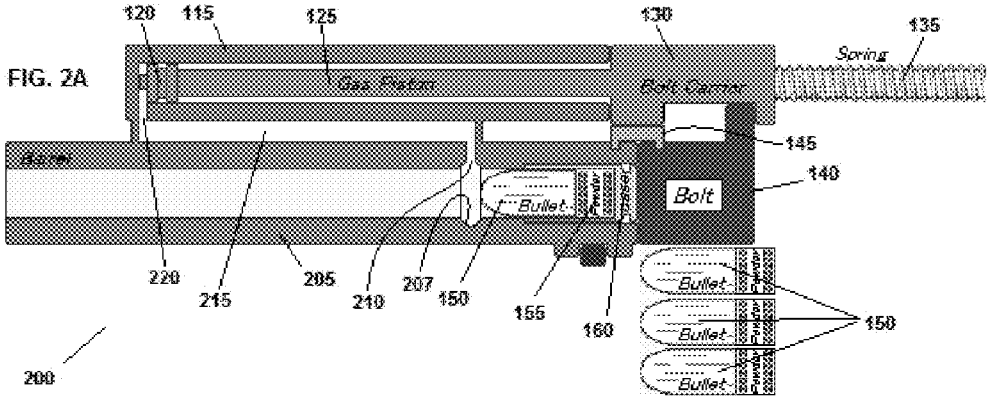
FIG. 2A is a side elevation section view of a simplified long-stroke gas-operation system of a firearm improved according to various example embodiments of the present disclosure, shown loaded and ready to fire.
Figure 2B:
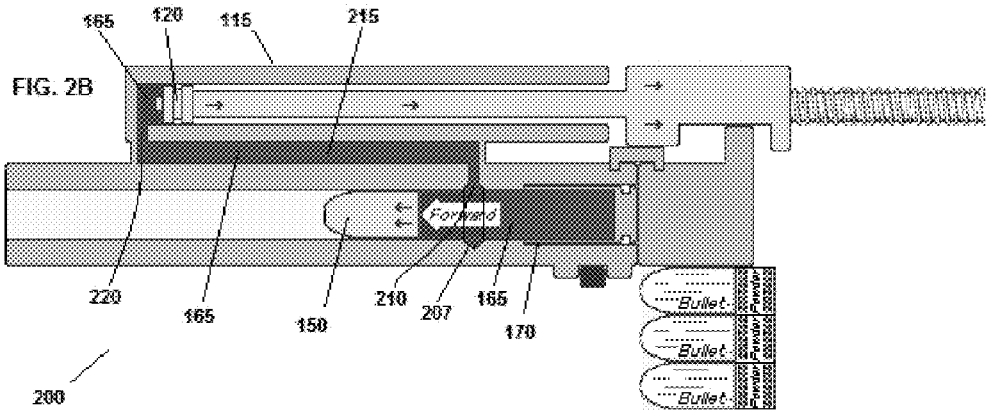
FIG. 2B is a side elevation section view of the system of FIG. 2A, shown immediately after firing, as a bullet leaves the firing chamber and begins to travel down the barrel, as the bullet travels past a gas port formed in an internal annular ring, allowing high-pressure gas behind the bullet to travel through the gas port, through a gas tube, to impinge on a piston, thereby causing a carrier assembly to begin to move backward (i.e., to the right).
Figure 2C:
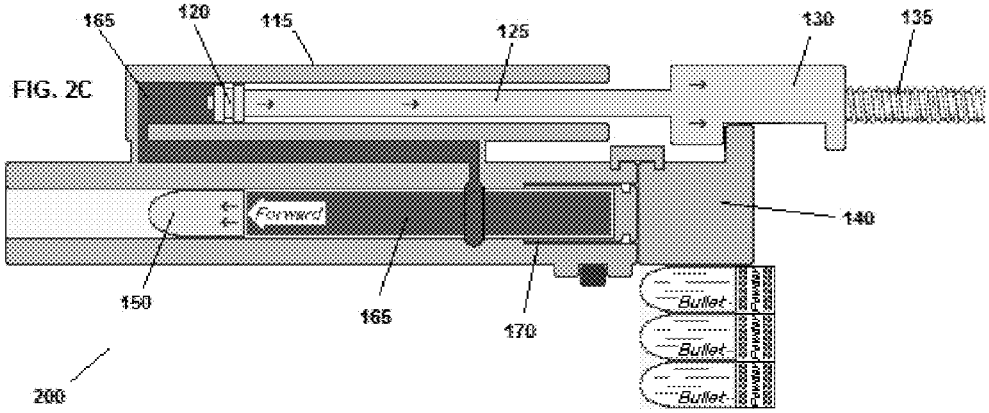
FIG. 2C is a side elevation section view of the system of FIG. 2B, shown a short time later, as the carrier assembly continues to move backward (to the right) and begins to engage the action of the firearm.
Figure 2D:
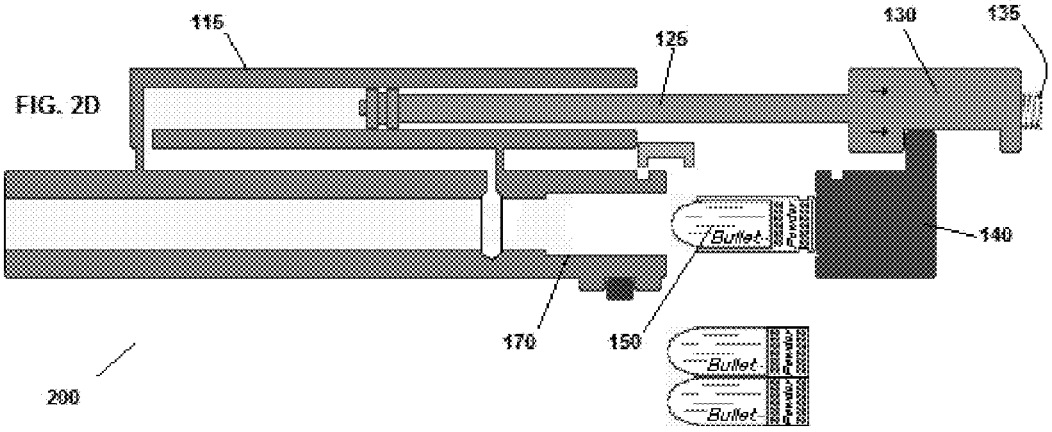
FIG. 2D is a side elevation section view of the system of FIG. 2C, shown a short time later, as the carrier assembly continues to move backward (to the right) via momentum, thereby actuating the action of the firearm to automatically reload the firearm.
Figure 2E:
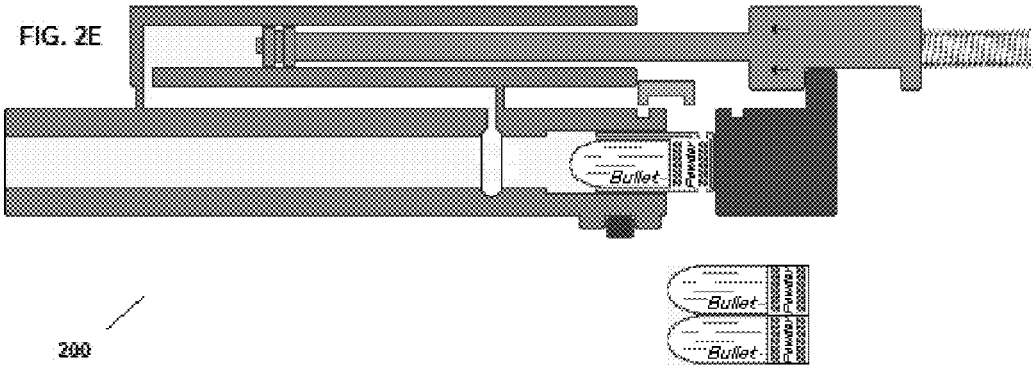
FIG. 2E is a side elevation section view of the system of FIG. 2D, shown a short time later, as the carrier assembly returns toward its starting position as shown in FIG. 2A.

With continuing reference to the example embodiment of an improved gas system 200 shown FIGS. 2A-2E, which illustrates multiple aspects, in use one or more gas ports 210 vent part of the pressurized gas 165 resulting from the firing of gunpowder 155 causing a bullet or other projectile(s) 150 (herein collectively, "bullet 150") to travel down the barrel 205 from a proximal end near the chamber 170 to a distal end where the bullet exits the barrel 205 through a muzzle (not shown). A portion of the high-pressure gas 165 proximate the chamber 170 is efficiently captured and directed into the one or more gas ports 210 by annular gas ring 207, which is shown formed in the interior of the barrel 205 and proximate the chamber 170 in this embodiment. The one or more gas ports 210 communicate high-pressure gas 165 distally through one or more gas tubes 215, through one or more cylinder ports 220, into the cylinder 115, where the high-pressure gas 165 impinges on the face of the piston 120, as depicted in FIGS. 2B-2C, all before the bullet 150 travels distally to the resting location of the piston 120. This is an improvement over prior devices 100 that only begin to communicate high-pressure gas 165 to the piston 120 after the bullet 150 travels further down the barrel, typically distally near or past the end of the piston 120, compare FIGS. 1A-1D.

In various example embodiments, the piston 120 may be connected by a piston rod or operation rod 125 to a bolt carrier 130, those parts together comprising a carrier assembly that may slide in the opposite direction of the bullet 150 (i.e., rearward, or in a proximal direction toward a user, which is toward the right in FIGS. 1-4 and 7-8B) when the pressurized gas 165 travels down the barrel 205 behind the bullet 150, through the gas ports 210, through the gas tubes 215, through one or more cylinder ports 220 into the cylinder 115, where it impinges on the face of the piston 120, as depicted in FIGS. 2B-2C. In various example embodiments the momentum of the rearward travel of the bolt carrier assembly may cause the bolt carrier 130 to unlock a locking block 145 that locks the bolt 140 to the chamber 170 (i.e., unlocks the "action"), followed by the bolt carrier 130 pushing the bolt 140 backwards (to the right in FIGS. 1-4 and 7-8B) away from the chamber 170, while expelling the spent casing 160 and introducing a new cartridge with bullet 150 into the chamber 170, as depicted in FIG. 2D. The rearward travel of the carrier assembly may be increasingly resisted by a spring 135, which may then urge the carrier assembly to travel back in the forward direction (to the left in the Figures, e.g., FIG. 2E), re-locking the bolt 140 to the chamber 170, whereupon the firearm returns to the position shown in FIG. 2A, ready to fire again.

Since the present system 200 can communicate pressure to the piston 120 more quickly than prior systems 100, the present system 200 may be adapted to cycle more rapidly than prior devices 100 as shown in FIGS. 1A-1D. Additionally, by tapping into the highest available pressure gas 165 near the chamber 170, efficiently capturing and directing that highest-pressure gas with an annular gas ring 207, and then communicating that highest-pressure gas 165 through distally-extending gas tubes 215 and cylinder ports 220, the volume and pressure of gas 165 available at the piston 120 may be significantly improved in consistency, regardless whether heavy or light loads are used, while reliably providing sufficient energy to drive piston 120, 320 even when very light loads are used.

Figure 3:
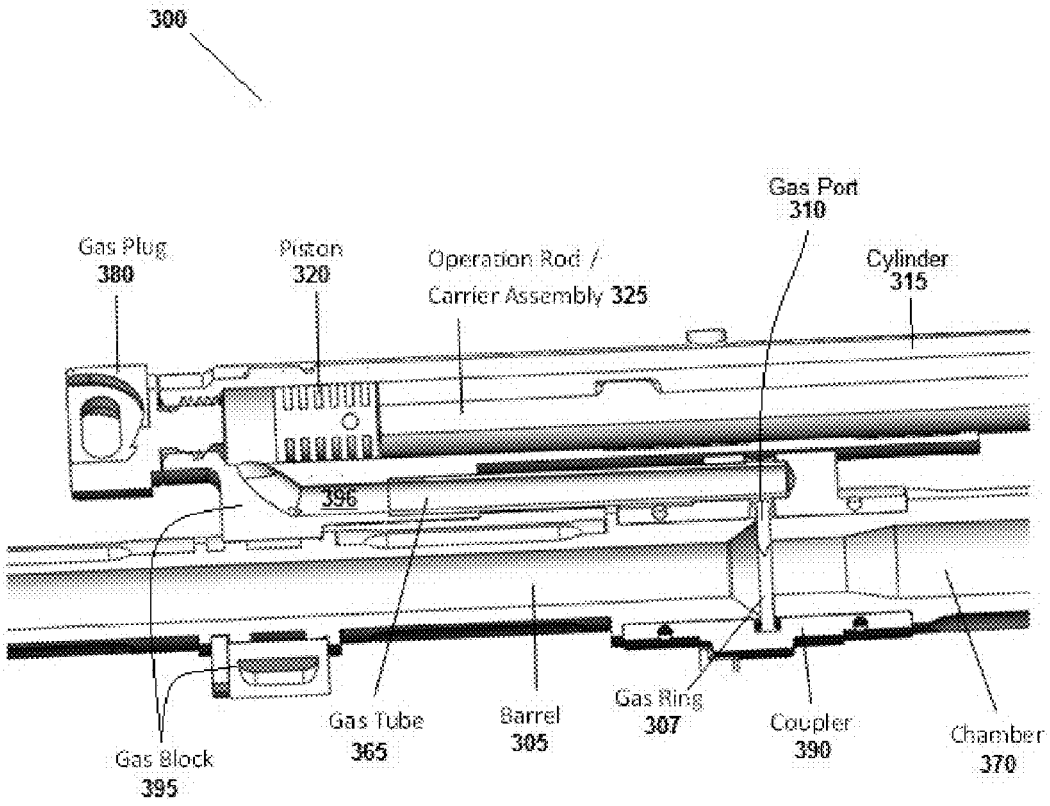
FIG. 3 is a side elevation section view of a long-stroke gas-operation system of a firearm improved according to various example embodiments of the present disclosure.
Figure 4:
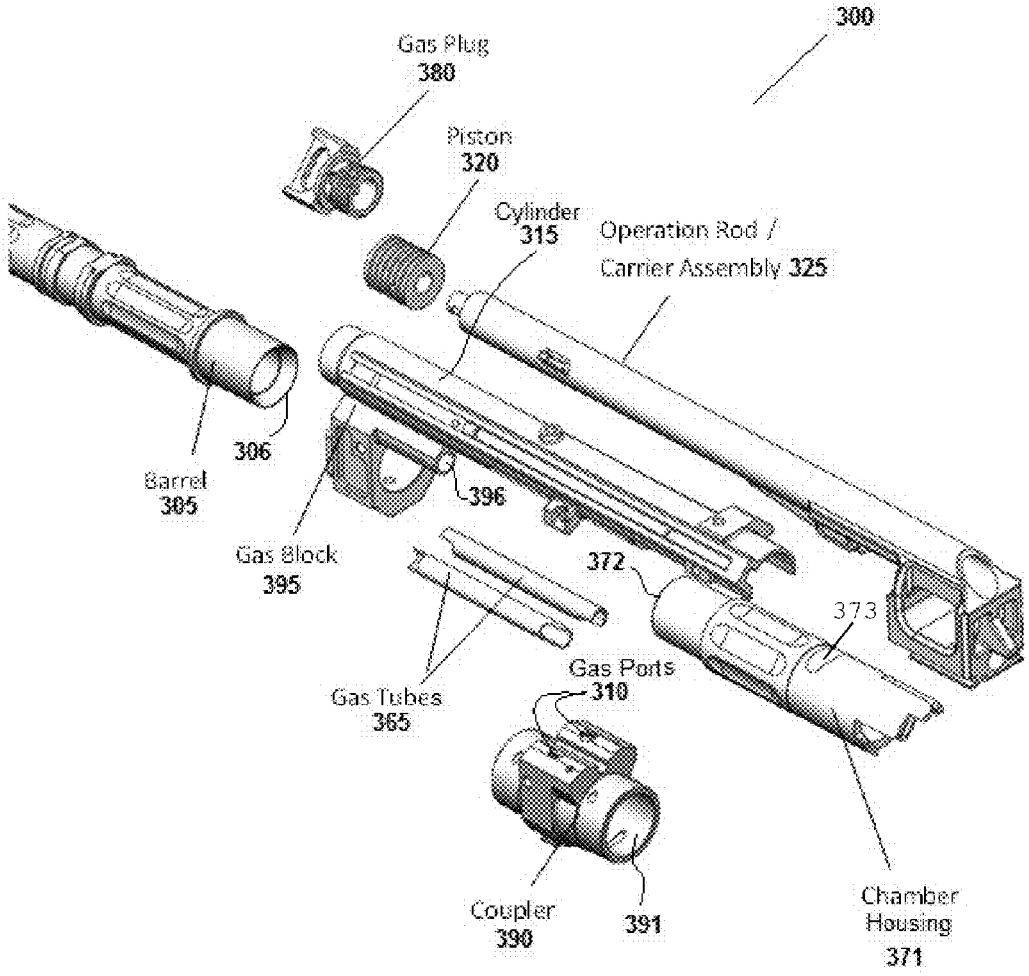
FIG. 4 is an exploded perspective view of the example system of FIG. 3, showing various example components.

Certain details regarding another example embodiment gas system are illustrated in FIGS. 3 and 4. Operating as set forth above with respect to example gas system 200, an example gas system may comprise a modular system 300 comprising a barrel 305 having a proximate end 306, a chamber housing 371 defining therein a chamber 370 and having a distal end 372, a coupler 390 comprising a longitudinally-extending inner circumferential surface 391 open on two ends, one end of the coupler 390 adapted to receive therein the proximate end 306 of the barrel 305, and the other end of the coupler 390 adapted to receive therein the distal end 372 of the chamber housing 371, such that the proximate end 306 of the barrel 305 and the distal end 372 of the chamber housing 371 are located proximate but separated from each other by a predetermined longitudinal distance within the coupler 390. When assembled as shown in FIG. 3, the space within the coupler 390 defined between the proximate end 306 of the barrel 305 and the distal end 372 of the chamber housing 371 is annular gas ring 307, into which gas ports 310 are formed. Gas ports 310, formed in coupler 390, may be adapted to be in gaseous communication with respective longitudinally-extending cylindrical gas tubes 365 each having their own body, which may be adapted to be in further gaseous communication with gas block 395, which may comprise corresponding cylinder ports 396 (FIG. 3) in gaseous communication with the face of piston 320 within cylinder 315. Gas block 395 may be adapted to surround and support the outer diameter of barrel 305 and may be formed as one-piece with the cylinder 315 (FIG. 4). For ease of maintenance and manufacture a removable and replaceable gas plug 380 may be located in the distal end of cylinder 315 to access the interior of cylinder 315. Piston 320 may be attached with operation rod/carrier assembly 325, which may function in a firearm as described above with respect the corresponding parts illustrated in FIGS. 2A-2E, or in any other suitable manner. In other embodiments, longitudinally-extending gas tubes 365 may not have their own body, and may be formed as part of another component, for instance as a through-hole or chamber formed in another component, for instance as shown in gas tube 215 in FIG. 2A.

Example embodiments of improved quick-release-barrel modular systems for long-stroke gas-operated firearms will now be described with reference to FIGS. 5 and 6. Provided in various example embodiments is a functional gas-operated modular firearm 500, comprising: a barrel assembly 520 removably attachable with a receiver assembly 510 solely by moving a quick-release mechanism 420 between a first position and a second position. In various example embodiments the receiver assembly 510 may comprise: a long-stroke gas-operation system comprising a piston 320 and longitudinally-extending operation rod 325 mechanically attached with and adapted to move together with a bolt group or bolt carrier 400 through an operating cycle of firing, extracting, and ejecting a first round and chambering a second round (see, e.g., FIGS. 2A-2E); a trunnion 410 having an opening 412 adapted to removably receive and locate therein a chamber portion 371 of the barrel assembly 520; the quick-release mechanism 420 attached with the trunnion 410 that when in the first position (e.g., inserted through hole 414 in trunnion 410 and engaged with notch 373 in chamber portion 371) is adapted to lock the barrel assembly 520 to the receiver assembly 510, and that when in the second position (e.g., disengaged from notch 373 in chamber portion 371 and removed from hole 414 in trunnion 410) is adapted to release the barrel assembly 520 from the receiver assembly 510. In various example embodiments the barrel assembly 520 may comprise a chamber portion 371 adapted to removably engage with the trunnion 410 and to house the first and second rounds for firing when removably engaged with the trunnion 410 (see, e.g., FIGS. 2A-2E); a longitudinally extending barrel portion 305 adapted to direct the first and second rounds after firing, and supporting thereon a gas cylinder 315; one or more gas communication ports 310 (see, e.g., FIGS. 3, 4) adapted to communicate to the gas cylinder 315 high-pressure gas from the firing of the first and second rounds; the gas cylinder 315 adapted to at least partially surround the piston 320 of the long-stroke gas-operation system (e.g., gas operation system 300, FIGS. 3, 4) when the chamber portion 371 is removably engaged with the trunnion 410, and to transmit to the piston 320 high-pressure gas from the firing of the first and second rounds that causes the long-stroke gas-operation system (e.g., gas operation system 300, FIGS. 3, 4) to move through the operating cycle, for instance as depicted in FIGS. 2A-2E.

In various example embodiments the first and second rounds that the receiver assembly 510 is adapted to house, fire, extract, eject, and chamber, include all of: any standard shotgun, rifle, or handgun round that is dimensionally no larger than a 12-gauge shotgun round. In various example embodiments the first and second rounds that the barrel assembly 520 is adapted to house and direct are selected from the group consisting of: any standard shotgun, rifle, or handgun round that is dimensionally no larger than a 12-gauge shotgun round. In various example embodiments the system 500 may further comprise a plurality of said barrel assemblies 520 removably attachable with and usable with a single one of said receiver assemblies 510, wherein a first of said barrel assemblies 520' is adapted to house and direct first and second rounds of a first caliber, and a second of said barrel assemblies 520" is adapted to house and direct first and second rounds of a second caliber that is different than the first caliber. In various example embodiments the first caliber and second caliber are each selected from the group consisting of: any standard shotgun, rifle, or handgun round that is dimensionally no larger than a 12-gauge shotgun round. Barrels of different lengths may also be quickly exchanged in a like manner.

In various example embodiments the quick-release mechanism may comprise a pin 420 adapted to pass through a hole 414 in the trunnion 410 and removably engage a groove 373 in an outer surface of the chamber portion 371 of the barrel assembly 520. A bracket or other support 430 may be provided around or about trunnion 410 and attached to a rail, cover, or another portion of the receiver assembly 510 to assist trunnion 410 in supporting the weight of barrel assembly 520. In various example embodiments the quick-release mechanism 420 is adapted to be moved between the first position and the second position, e.g., removed from hole 414, by hand and without tools, for instance by a user grabbing pin 414 with their fingers and pulling it out of or pushing it into hole 414. Any other suitable quick-release mechanism may be used instead of quick-change pin 420, such as a cam and lever system, latch, clamp, button, spring, or any other structure that is movable from a first position that locks two structures together, to a second position that unlocks the two structures from each other.

In various example embodiments the barrel assembly 520 further comprises a gas adjusting system 380 adapted to allow a user to adjust the pressure of the gas to which the piston 320 is exposed during use, for instance by adjustably opening a valve or port via rotation of gas plug 380.

Figure 5:
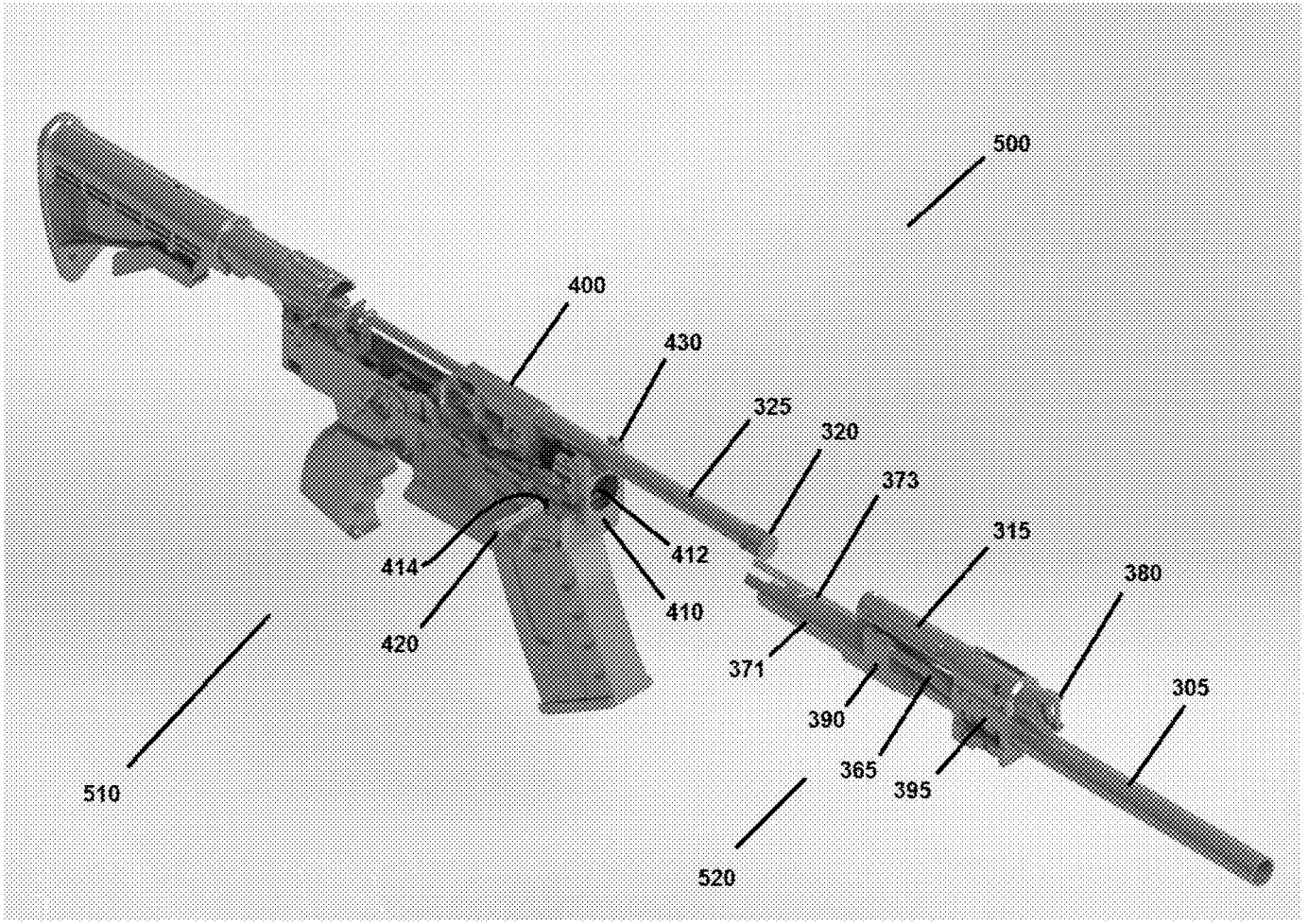
FIG. 5 is a perspective view of an example quick-release-barrel modular system for long-stroke gas-operated firearms, shown disassembled.
Figure 6:
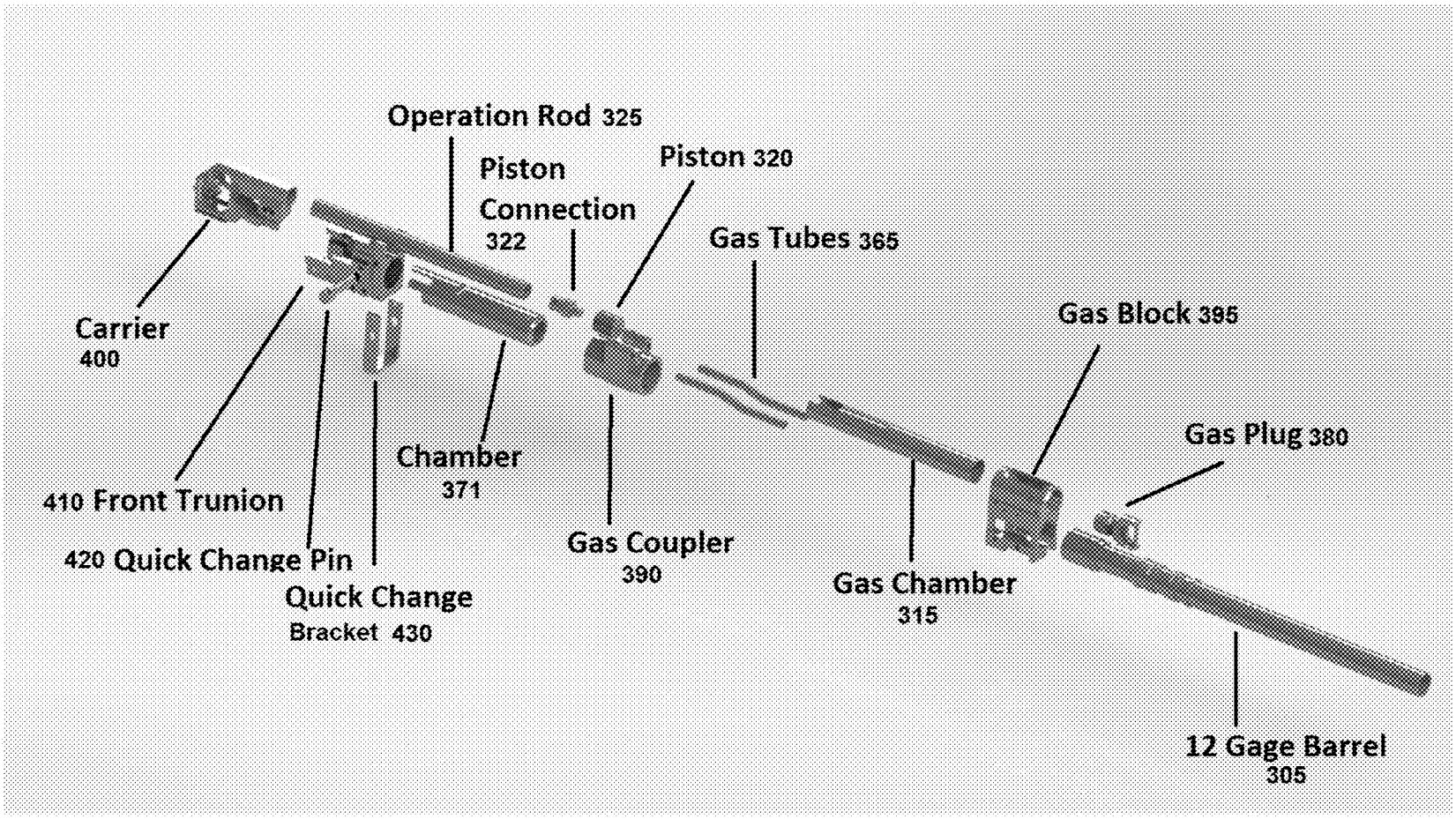
FIG. 6 is an exploded perspective view of the example system of FIG. 5, showing various example components.

In various example embodiments the barrel assembly 520 is adapted to be removed from the receiver assembly 510 without rotating the barrel assembly 520 with respect to the receiver assembly 510, for instance as depicted in FIG. 5. The barrel assembly 520 is likewise adapted to be removed from the receiver assembly 510 without having to remove the bolt carrier or operation rod from the receiver, or taking any other steps besides pulling pin 420. The present system 500 thus provides an improved quick-release-barrel modular system for long-stroke gas-operated firearms that allows barrels of different calibers, all the way from 12-gauge shotgun to most rifle rounds and handgun rounds, to be changed-out on a single AK-style receiver simply by pulling a pin 420 and lifting-off the barrel assembly 520, then sliding-on a different barrel assembly 520', and re-inserting the pin 420. Example systems 500 may utilize the improved gas system 300 disclosed herein, but standard or original AK-style gas systems can likewise be used with example systems 500. Likewise, Example systems 500 may utilize the improved forward-charging handle system 700 disclosed herein, but standard or original AK-style charging handles can likewise be used with example systems 500.

Figure 7:
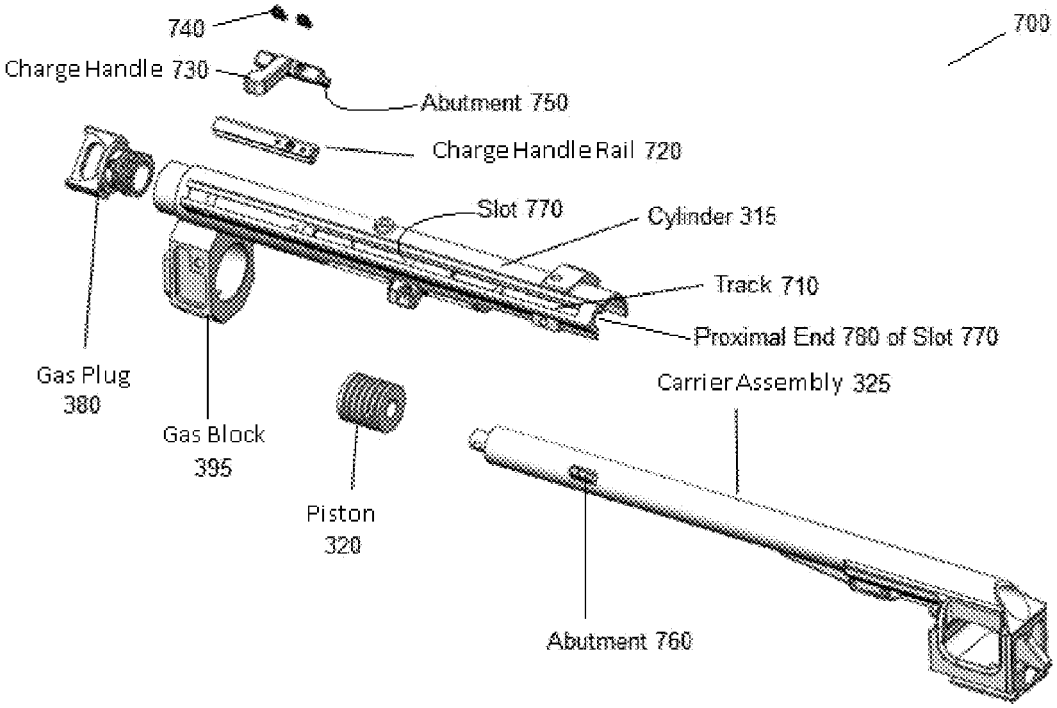
FIG. 7 is an exploded perspective view of an example forward-charging handle system, showing various example components.
Figure 8A:
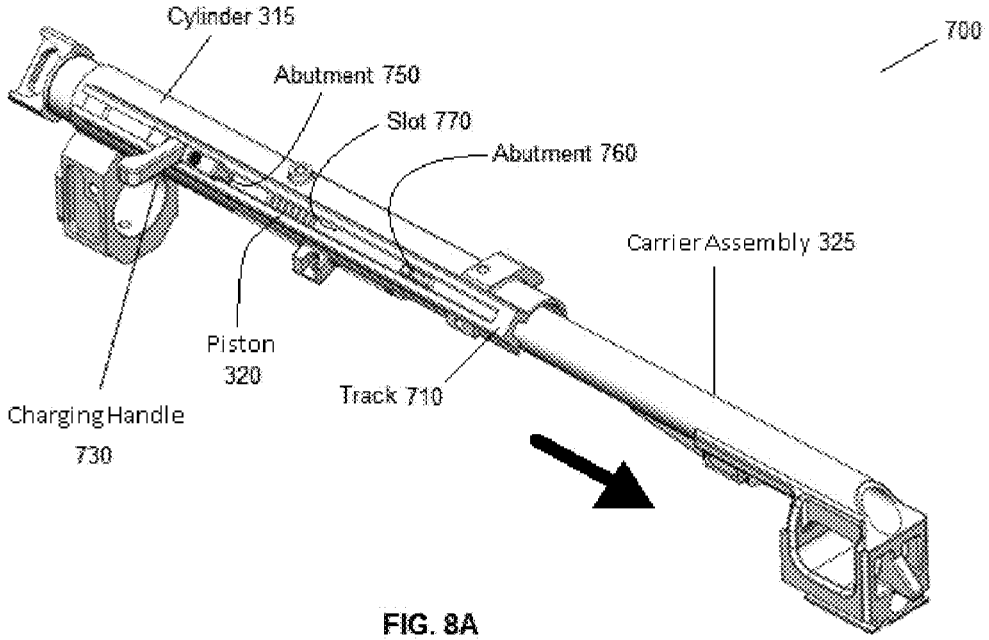
FIG. 8A is a perspective view of the example forward-charging handle system of FIG. 7, shown assembled with the carrier assembly retracted proximally toward a user.
Figure 8B:
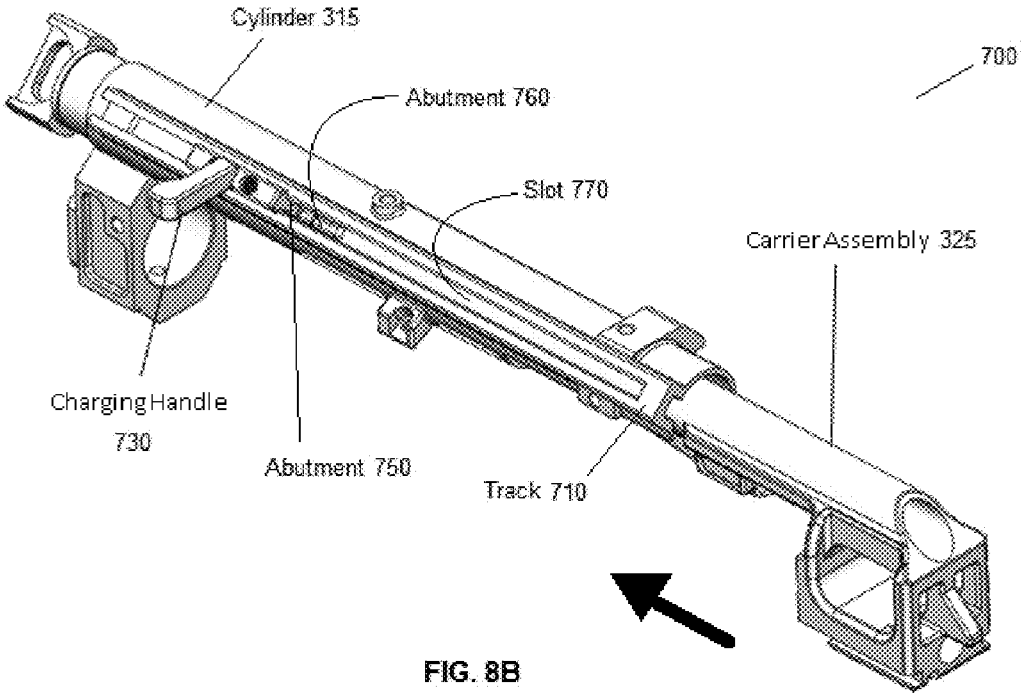
FIG. 8B is a perspective view of the example forward-charging handle system of FIG. 7, shown assembled with the carrier assembly extended distally away from a user.

Turning next to improved forward-charging handle systems, disclosed herein in various example embodiments and depicted in FIGS. 7, 8A, and 8B is a gas-operated firearm adapted to be cycled pneumatically by a piston assembly (320, 325) reciprocating longitudinally between a distal position (i.e., forward, or away from a user) and a proximal position (i.e., backward, or toward a user) in a cylinder 315 when exposed to high-pressure gas from the firing of rounds (see, e.g., FIGS. 2A-2E). Such gas-operated firearms may be improved by providing a hand-charging system 700 comprising: an elongated slot 770 in a wall of the cylinder 315, the slot 770 extending longitudinally from a distal portion of the wall of the cylinder 315 (toward the left in FIGS. 7, 8A, and 8B) proximally through an open gap 780 in a proximal end of the wall of the cylinder 315. A first abutment 760 may be fixedly connected with the longitudinally-reciprocating piston/carrier assembly 325, the first abutment 760 protruding outwardly through the elongated slot 770 as illustrated in FIGS. 8A and 8B. A charge handle structure 730 may be slidably attached with an exterior surface of the cylinder 315 and positioned to contact the first abutment 760 and urge the longitudinally-reciprocating piston/carrier assembly 325 in a proximal direction (as indicated by arrow in FIG. 8A) to charge the firearm when the charge handle structure 730 is slid in the proximal direction. The charge handle structure 730 may be adapted to return to a position distal (to the left in FIGS. 7, 8A, and 8B) of the first abutment 760 and remain there during firing of rounds as indicated in FIGS. 8A and 8B (where the charge handle structure 730 is shown remaining stationary while the longitudinally-reciprocating piston/carrier assembly 325 moves back and forth within the cylinder 315).

In various example embodiments the hand-charging system 700 further comprises the charge handle structure 730 comprising a second abutment 750 adapted and positioned to contact the first abutment 760 as shown in FIG. 8B. In various example embodiments the hand-charging system 700 further comprises a longitudinally-extending track 710 attached to the exterior wall of the cylinder 315 proximate the elongated slot 770, the longitudinally-extending track 710 adapted to slidably engage the charge handle structure 730. In various example embodiments the charge handle structure 730 comprises a rail portion 720 adapted to slide within the longitudinally-extending track 710 and a handle portion 730 attached to the rail portion 720, for instance with fasteners 740, and extending radially away from the longitudinally-extending track 710.

As will be apparent to persons of skill in the art upon reviewing the Figures, a cylinder 315 having the construction shown in FIGS. 7, 8A, and 8B may be removed from the firearm without disassembling the charge handle structure 730 and without removing the charge handle structure 730 from the cylinder 315, because the charge handle structure is provided on the exterior of the cylinder 315, and the first abutment 760 on the piston/carrier assembly 325 may slide out of the proximal end of slot 770 through the open gap 780. Accordingly, the cylinder 315 is adapted to be removed from the firearm by sliding the cylinder 315 distally off the piston/carrier assembly 325 without rotating the cylinder 315 relative to the piston/carrier assembly 325. This improved hand-charging system 700 can be adapted for use with any long-stroke gas-operated firearm and provides many of the advantages of Dublin, including improved positioning of the handle forward and on the left side of the firearm, an opening 770 into the cylinder 315 that promotes self-cleaning, and a handle 730 that does not reciprocate back and forth as the firearm is fired. But unlike Dublin, which requires disassembly of the gas tube to remove a sleeve that encircles the operation rod, the present hand-charging system 700 can be used seamlessly with quick-release-barrel modular systems 500 for long-stroke gas-operated firearms as disclosed herein, because the system 700 is adapted to slide right off the firearm along with the gas cylinder 315 and barrel 305 without requiring any rotation or disassembly. Also notable is the increased simplicity and reliability provided by the combination of the cylinder 315 with the gas block 395 in various example embodiments.

Firearms can be provided with any or all of the features disclosed herein. It is understood that the above-described embodiments are merely illustrative of the application. Other embodiments may be readily devised by those skilled in the art, which may embody one or more aspects or principles of the invention and fall within the scope of the claims.

What is claimed is:

1. A functional gas-operated modular firearm, comprising:

a receiver assembly comprising:

a long-stroke gas-operation system comprising a piston and longitudinally-extending operation rod mechanically attached with and adapted to move together with a bolt group through an operating cycle of firing, extracting, and ejecting a first round and chambering a second round;

a trunnion having an opening adapted to removably receive and locate therein a chamber portion of a barrel assembly;

a pin attached with the trunnion such that when in a first position the pin is adapted to lock the barrel assembly to the receiver assembly, and that when in a second position the pin is adapted to release the barrel assembly from the receiver assembly, wherein the pin is adapted to pass through a hole in the trunnion and removably engage a groove in an outer surface of the chamber portion of the barrel assembly; and wherein the barrel assembly comprises:

the chamber portion adapted to removably engage with the trunnion and to house the first and second rounds for firing when removably engaged with the trunnion;

a longitudinally extending barrel portion adapted to direct the first and second rounds after firing, and supporting thereon a gas cylinder;

one or more gas communication ports adapted to communicate to the gas cylinder high-pressure gas from the firing of the first and second rounds;

the gas cylinder adapted to at least partially surround the piston of the long-stroke gas-operation system when the chamber portion is removably engaged with the trunnion, and to transmit to the piston high-pressure gas from the firing of the first and second rounds that causes the long-stroke gas-operation system to move through the operating cycle;

the barrel assembly removably attachable with the receiver assembly by movement of the pin; and the barrel assembly constructed to be removable from and replaceable into the functional gas-operated modular firearm by said movement of said pin without having to remove or replace any other fasteners or parts.

2. The functional gas-operated modular firearm of claim 1, wherein:

the first and second rounds that the receiver assembly is adapted to house, fire, extract, eject, and chamber, include all of: any standard shotgun, rifle, or handgun round that is dimensionally no larger than a 12-gauge shotgun round.

3. The functional gas-operated modular firearm of claim 2, wherein:

the first and second rounds that the barrel assembly is adapted to house and direct are selected from the group consisting of: any standard shotgun, rifle, or handgun round that is dimensionally no larger than a 12-gauge shotgun round.

4. The functional gas-operated modular firearm of claim 2, further comprising:

a plurality of said barrel assemblies removably attachable with and usable with a single one of said receiver assemblies, wherein a first of said barrel assemblies is adapted to house and direct first and second rounds of a first caliber, and a second of said barrel assemblies is adapted to house and direct first and second rounds of a second caliber that is different than the first caliber.

5. The functional gas-operated modular firearm of claim 4, wherein:

the first caliber and second caliber are each selected from the group consisting of: any standard shotgun, rifle, or handgun round that is dimensionally no larger than a 12-gauge shotgun round.

6. The functional gas-operated modular firearm of claim 1, wherein:

the pin is adapted to be moved between the first position and the second position by hand and without tools.

7. The functional gas-operated modular firearm of claim 1, wherein:

the barrel assembly further comprises a gas adjusting system adapted to allow a user to adjust the pressure of the gas to which the piston is exposed during use.

8. The functional gas-operated modular firearm of claim 1, wherein:

the barrel assembly is adapted to be removed from the receiver assembly without rotating the barrel assembly with respect to the receiver assembly.

9. A functional gas-operated modular firearm, comprising:

a receiver assembly comprising:

a long-stroke gas-operation system comprising a piston and longitudinally-extending operation rod mechanically attached with and adapted to move together with a bolt group through an operating cycle of firing, extracting, and ejecting a first round and chambering a second round;

a trunnion having an opening adapted to removably receive and locate therein a chamber portion of a barrel assembly;

a quick-release mechanism attached with the trunnion that when in the first position is adapted to lock the barrel assembly to the receiver assembly, and that when in the second position is adapted to release the barrel assembly from the receiver assembly; and the barrel assembly comprising:

the chamber portion adapted to removably engage with the trunnion and to house the first and second rounds for firing when removably engaged with the trunnion;

a longitudinally extending barrel portion adapted to direct the first and second rounds after firing, and supporting thereon a gas cylinder;

one or more gas communication ports adapted to communicate to the gas cylinder high-pressure gas from the firing of the first and second rounds; the gas cylinder adapted to at least partially surround the piston of the long-stroke gas-operation system when the chamber portion is removably engaged with the trunnion, and to transmit to the piston high-pressure gas from the firing of the first and second rounds that causes the long-stroke gas-operation system to move through the operating cycle;

the barrel assembly removably attachable with a receiver assembly by moving a quick-release mechanism between a first position and a second position;

the functional gas-operated modular firearm further comprising a hand-charging system comprising:

an elongated slot in a wall of the gas cylinder, the slot extending longitudinally from a distal portion of the wall proximally through an open gap in a proximal end of the wall;

a first abutment fixedly connected with the longitudinally-extending operation rod, the first abutment protruding outwardly through the elongated slot;

a charge handle structure slidably attached with an exterior surface of the gas cylinder and positioned to contact the first abutment and urge the longitudinally-extending operation rod in a proximal direction to charge the firearm when the charge handle structure is slid in a proximal direction;

the charge handle structure adapted to return to a position distal of the first abutment and remain there during firing of rounds;

wherein the gas cylinder is adapted to be removed from the firearm without disassembling the charge handle structure and without removing the charge handle structure from the cylinder.

* * * * *